United States Patent [19]

Barner

[11] 4,344,409

[45] Aug. 17, 1982

[54] ARROW REST APPARATUS

[76] Inventor: Roland K. Barner, 119 Sunset Blvd., Bozeman, Mont. 59715

[21] Appl. No.: 172,386

[22] Filed: Jul. 25, 1980

[51] Int. Cl.[3] ..... F41B 5/00

[52] U.S. Cl. ..... 124/24 R; 124/41 A

[58] Field of Search ..... 124/41 A, 24 R, 88, 124/22

[56] References Cited

U.S. PATENT DOCUMENTS 2,975,780 3/1961 Fisher ..... 124/24 R 3,504,659 4/1970 Babington ..... 124/41 A X

*Primary Examiner*—Richard C. Pinkham

*Assistant Examiner*—William R. Browne

*Attorney, Agent, or Firm*—Arthur L. Urban

[57] ABSTRACT

An arrow rest apparatus capable of being mounted on an archery bow adjacent the point of contact of an arrow with the bow. The arrow rest apparatus includes support structure, a shaft member rotatably carried by the support structure, the shaft member being oriented so that the axis thereof is substantially perpendicular to the axis of the arrow, first biasing mechanism associated with the shaft member urging rotation of the shaft member in one direction, arrow supporting structure affixed to the end of the shaft member closest to the arrow, and a latch mechanism associated with the shaft member. The latch mechanism includes a portion affixed to the shaft member, an arm portion pivotally mounted on the support structure, the arm portion being engageable with the shaft affixed latch portion. The arm portion includes a weighted section remote from the shaft affixed latch portion, second biasing mechanism urging the arm portion away from the shaft affixed latch portion, and structure for mounting the apparatus on an archery bow.

14 Claims, 8 Drawing Figures

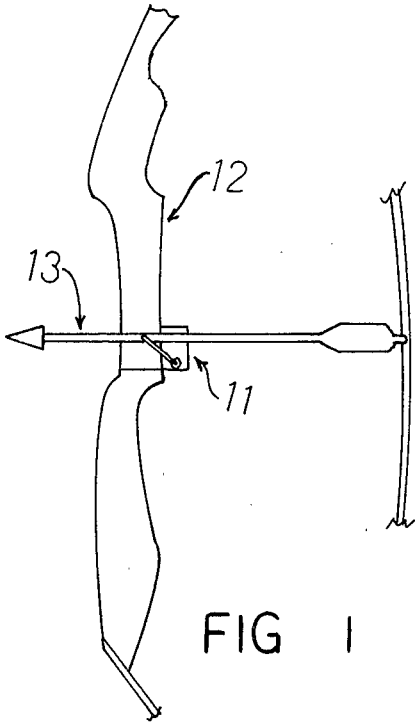
FIG 1
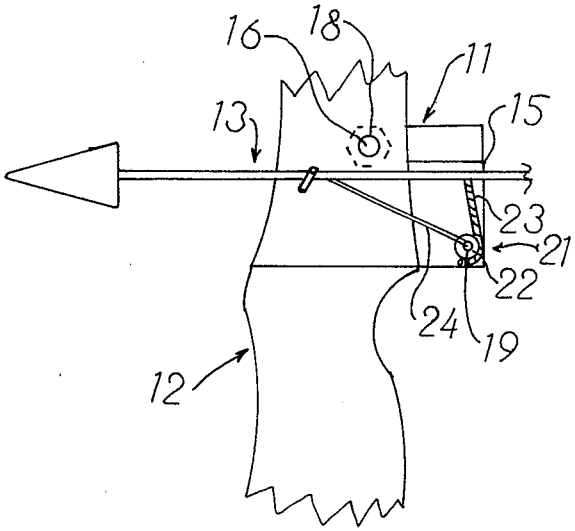
FIG 2
FIG 3
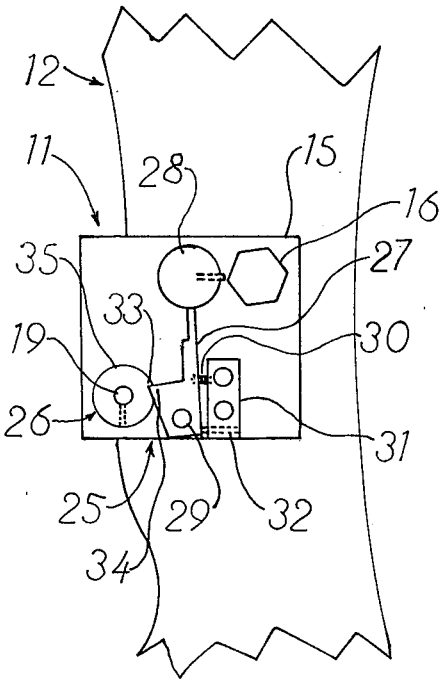
FIG 4
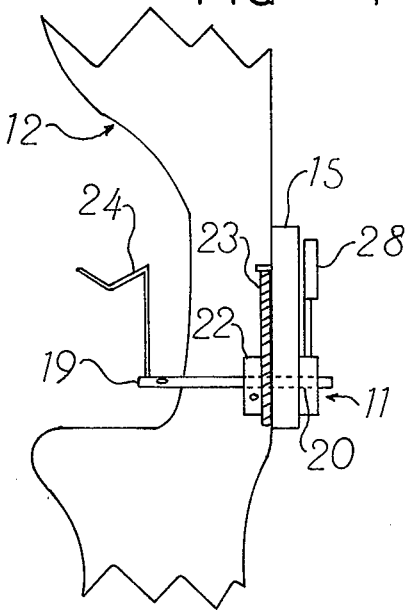

ARROW REST APPARATUS

This invention relates to a novel arrow rest apparatus and more particularly relates to a new apparatus capable of being mounted on an archery bow on which to rest an arrow prior to release thereof.

Archery bows have been used for many centuries. Originally, bows were utilized as weapons either for killing game for food or for defending against enemies. With the invention of firearms, archery bows lost their popularity because firearms had more range and killing power. Archery continued on a small scale as a sport. However, in recent years, archery has become more popular largely due to the increased use of bows for hunting.

Some hunters have turned to bows for hunting because they feel that firearms have reduced the sport of hunting into a slaughter. The technology of firearms and ammunition, in the opinion of some hunters, has advanced to such a degree that hunting skill is becoming less important than the type of firearm and ammunition.

These hunters found that archery hunting provided a strong test for their hunting skills. The limited range of arrows forced hunters to use their knowledge and experience to a much greater degree than was required with firearm hunting. This challenge frequently increased the hunter's interest in the sport and in turn gave him more satisfaction when he accomplished his objective of killing the game he had selected.

With the increased interest in archery, greater effort has been expended in improving archery equipment. The wide variety of bows, arrows and accessories being offered on the market is an indication of these efforts. One development which has created considerable interest is the use of arrow rests. Arrow rests are devices which are mounted on bows to stabilize the position of an arrow prior to release of the bow string. The arrow rest is designed to project from the bow to support the front of the arrow as the bow string is drawn back. When an arrow rest is not employed to stabilize the arrow, the archer rests the arrow on the hand that he uses to hold the bow. The use of the hand as a stabilizer may reduce the accuracy of the flight of the arrow.

Initially, arrow rests were fixed in place with the arrow sliding over them when the bow string was released. One of the problems with fixed rests is that the fletching of the arrow may hit the rest as the arrow moves forward. This contact of the fletching with the rest can change the flight of the arrow causing the arrow to miss its target.

In an attempt to reduce the effect of the contact between the rest and the fletching of the arrow, movable rests have been proposed. These rests frequently utilize a pivoting support arm. As the arrow moves forward, the arrow causes the pivotable arm to yield in its force and deflect from the path of the arrow. While this construction may reduce the resistance offered by the rest to the moving arrow, it is apparent that even a pivoting rest must be pushed from the arrow path by the contact of the arrow with the rest. Since even slight contact with the rest can cause the flight of the arrow to be changed, movable rests offered heretofore have not provided the improvements desired.

The present invention provides a bow with a novel arrow rest or support apparatus with features and advantages not present on arrow rests heretofore available. The arrow rest apparatus of the invention facilitates positioning of the arrow before release without changing the flight characteristics of the arrow after release. The apparatus does not interfere with the flight of the arrow. Also, the arrow rest moves from the path of the arrow without depending on contact with the arrow to achieve movement.

The arrow rest of the present invention is simple to install on an archery bow and can be used by archers, even inexperienced individuals, with a minimum of instruction. The apparatus can be transferred from one bow to another if desired quickly and conveniently.

The arrow rest apparatus is simple in design and can be manufactured relatively inexpensively. The arrow rest apparatus can be fabricated from commercially available materials and components using conventional metal working and assembling techniques with semi-skilled labor.

Other benefits and advantages of the novel arrow rest apparatus of the present invention will be apparent from the following description and the accompanying drawings in which:

FIG. 1 is a side elevation of one form of the arrow rest apparatus of the invention mounted on an archery bow;

FIG. 2 is an enlarged fragmentary view of the arrow rest apparatus shown in FIG. 1;

FIG. 3 is an enlarged fragmentary view of the opposite side of the arrow rest apparatus shown in FIG. 2; and FIG. 4 is a right end view of the arrow rest apparatus shown in FIGS. 1–3.

Figure 5:
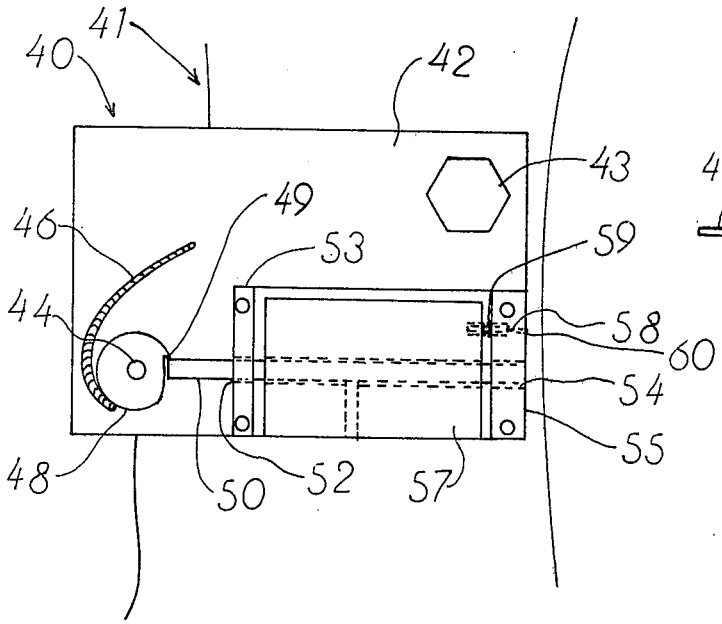
FIG. 5 is an enlarged side view of another form of the arrow rest apparatus of the invention mounted on an archery bow.

As shown in FIGS. 1–4 of the drawings, one form of the novel arrow rest apparatus 11 of the invention is mounted on an archery bow 12. The arrow rest 11 is mounted on the bow 12 adjacent the point of contact of an arrow 13 with the bow when the arrow is in position for release.

The arrow rest apparatus 11 includes support means shown as plate 15 through which the apparatus is secured to the bow. The apparatus can be secured in position with suitable fastening means such as a bolt 16 or screws, an adhesive or the like advantageously extending through opening 18 in the support plate 15. The arrow rest apparatus 11 also includes a shaft member 19 that is rotatably carried by the support plate 15. Preferably, support plate 15 includes an opening 20 through which shaft 19 extends.

Biasing means 21 is associated with the shaft member 19. The biasing means 21 urges rotation of shaft member 19 in one direction. The biasing means 21 advantageously includes a grooved circular section 22 and a coil spring member 23. One end of coil spring member 23 is affixed to the circular section 22 and wrapped partway around same. The opposite end of the coil spring member 23 is affixed to the support 15.

Arrow supporting means 24 is affixed to one end of the shaft member 19. As shown, the arrow supporting means 24 is affixed to the end of the shaft member 19 closest to the arrow 13. The arrow support 24 may be formed of a bent wire, a plastic card or the like with a notch on which the arrow rests.

The arrow rest apparatus 11 of the invention further includes latch means 25. The latch means 25 includes one portion 26 affixed to the shaft member 19 and a pivotable arm portion 27 which is engageable with the shaft affixed latch portion 26. The arm portion 27 which includes a weighted section 28 remote from the shaft affixed latch portion 26 is pivotally mounted on a pin 29. The weighted section 27 advantageously is separable from the arm portion 27. Second biasing means shown as spring 30 urges the arm portion 27 toward the shaft affixed latch portion 26.

Stop or block means 31 is disposed adjacent the arm portion 27. The stop means 31 controls the travel or movement of the arm portion 27. Advantageously, the stop means includes adjustment means such as set screw 32 to change the travel of the arm portion. The spring 30 may be incorporated with the stop 31 if desired.

Latch means 25 preferably includes notch means 33 and hook means 34 engageable therewith. As shown in the drawings, notch means 33 is disposed on shaft affixed portion 26 and hook means 34 is a part of movable arm portion 27. Advantageously, notch means 33 may be located on a cylindrical section 35.

Figure 6:
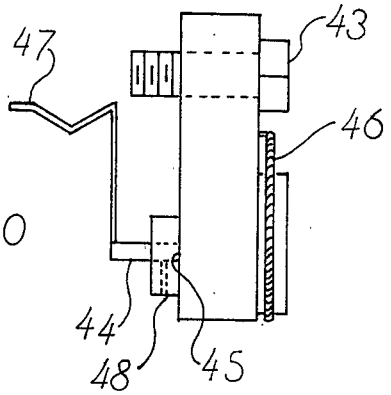
FIG. 6 is a left end view of the arrow rest apparatus shown in FIG. 5.

In FIGS. 5 and 6 is shown another form of the arrow rest apparatus of the invention. As shown, arrow rest apparatus 40 is mounted on an archery bow 41. The arrow rest 40 includes support means shown as plate 42. The apparatus 40 is secured to the bow 41 with a bolt 43. The arrow rest 40 also includes a shaft member 44 which extends through an opening 45 in support plate 42.

Biasing means shown as coil spring 46 has one end affixed to a cylindrical section 48 carried by shaft 44 and the opposite end is affixed to plate 42. Arrow supporting means 47 extends from the end of shaft 44 closest to the arrow (not shown). The arrow support 47 may be of a type similar to that shown in FIGS. 1–4.

The arrow rest apparatus 40 further includes latch means. The latch means includes a notch 49 in cylindrical section 48 which is engageable with the end of a slidable arm or bar member 50. Bar member 50 is slidably disposed in openings 52 and 54 of support sections 53 and 55, respectively. Support sections 53 and 55 are affixed to plate 42 advantageously in a substantially parallel relationship with openings 52 and 54 axially aligned.

A weight 57 is affixed to bar member 50 such as with a set screw. The length of weight 57 is somewhat shorter than the distance between the spaced support sections 53 and 55. A guide pin 58 extends from one end of weight 57 through an opening 60 in support section 55. Second biasing means shown as spring 59 urges weight 57 toward support section 53 and away from support section 55.

Figure 7:
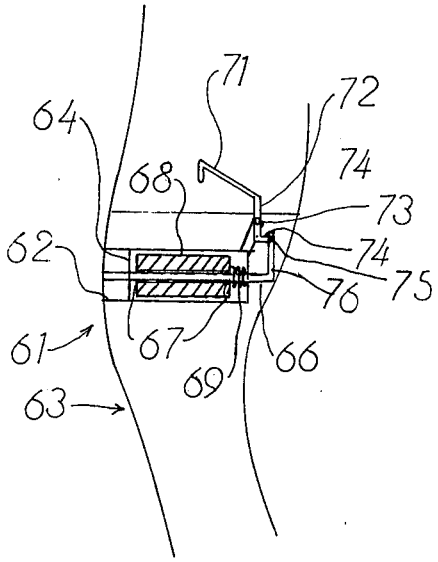
FIG. 7 is an enlarged side view in section of a further form of the arrow rest apparatus of the invention mounted on an archery bow.
Figure 8:
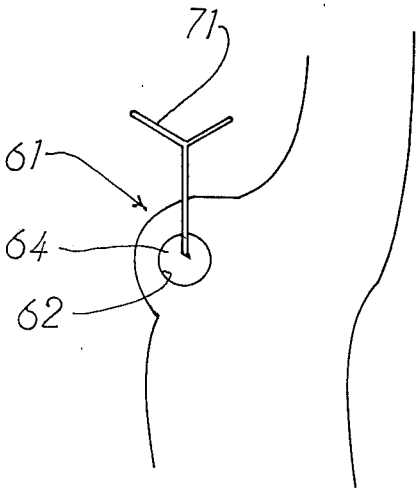
FIG. 8 is a right end view of the arrow rest apparatus shown in FIG. 7.

FIGS. 7 and 8 illustrate a further form of the arrow rest apparatus of the invention. Arrow rest apparatus 61 is mounted in a cavity 62 in archery bow 63. The arrow rest 61 includes a housing shown as cylinder 64. An arm or bar member 66 is slidably carried in openings 67 in the ends of the housing 64. A weight 68 is affixed to bar member 66 along the length thereof. A spring 69 is disposed adjacent one end of the weight and urges the weight against the left end of the housing 64.

The arrow rest apparatus 61 also includes arrow supporting means 71. The arrow supporting means 71 which includes a section 72 is pivotally connected to a shaft 73 with a spring substantially perpendicular to the axis of an arrow (not shown). The lower end of section 72 has a hook portion 74 which is engageable with a notch 75 in an upwardly extending section 76 of bar member 66.

In the use of the arrow rest apparatus of the present invention as shown in FIGS. 1–4 of the drawings, the apparatus 11 is mounted on an archery bow 12 by fastening support plate 15 to the bow with a bolt 16. The apparatus is secured to the bow adjacent the point that arrow 13 would contact the bow when the arrow is in position to be released. The apparatus 11 is oriented so that the arrow supporting member 24 will contact the arrow when in a raised position and will be spaced from the arrow when in a lowered position.

After the apparatus 11 has been mounted properly, the bow 12 is grasped in the conventional manner and the arrow support 24 raised into position. Then, an arrow 13 is placed into position for shooting with the forward part of the arrow resting on the arrow support 24 and the rear in engagement with the bow string. The rear of the arrow and the string are drawn back and the arrow aimed for flight.

When proper aim has been achieved, the string is released driving the arrow forward. Release of the string causes the bow to move backward slightly in a counteracting effect. This backward movement of the bow 12 moves the apparatus 11 with it. However, the mass of weighted section 28 on the end of arm portion 27 causes the inertia weight to resist rearward movement. This resistance causes arm portion 27 to pivot, moving hook 34 away from notch 33.

Release of the latch mechanism frees shaft 19 for rotation. Since shaft 19 is being urged to rotate by coil spring 23, the shaft will rotate causing arrow support 24 to move downwardly away from the arrow before the fetching of the arrow has contacted the arrow support. Thus, the flight of the arrow is not changed from its original selected path since there has been no contact between the fetching of the arrow and the arrow support.

The arrow rest apparatus shown in FIGS. 5 and 6 is used substantially the same way as the apparatus shown in FIGS. 1–4. In the operation of the apparatus of FIGS. 5 and 6, release of the arrow causes the bow 41 to move rearwardly with the weight 57 resisting rearward movement. Since weight 57 is affixed to bar member 50, the rearward movement of the bar 50 also will be retarded.

This difference in the rate of rearward movement of the bar member 50 and the notched cylinder 48 will cause the bar member to move from the notch 49 allowing spring 46 to rotate shaft 44 and move the arrow support 47 downwardly. Thus, the arrow support 47 will move away from the path of the arrow before the fetching of the arrow has contacted the arrow support.

The arrow rest apparatus 61 shown in FIGS. 7 and 8 relies on the resistance of a weight 68 to withdraw notch 75 on bar member 66 from hook 74 of the arrow support assembly. The release of the latching mechanism permits the arrow support 71 to swing downwardly away from the path of the released arrow so that the path of the arrow is not changed by contact with the arrow rest.

The above description and the accompanying drawings show that the present invention provides a novel arrow rest apparatus which does not change the flight of an arrow. The arrow rest apparatus of the invention provides support for an arrow before release without interfering with the flight of the arrow. The arrow rest moves from the path of the arrow without depending on contact with the arrow to achieve such movement.

The arrow rest apparatus of the invention is simple to install and easy to use even by inexperienced archers after only a minimum of instruction. The apparatus can be installed quickly and can be transferred from one bow to another conveniently.

The arrow rest apparatus is simple in design and can be manufactured from commercially available materials. The apparatus can be fabricated relatively inexpensively using conventional metal working techniques with semiskilled labor.

It will be apparent that various modifications can be made in the particular arrow rest apparatus described in detail and shown in the drawings within the scope of the invention. For example, the size and configuration of components can be changed to meet specific requirements. The apparatus can be fabricated from a variety of materials such as metals, plastics, wood and the like. The type and weight of the springs employed can be different provided the operation of the apparatus is not deleteriously affected. Therefore, the scope of the invention is to be limited only by the following claims.

What is claimed is:

1. Arrow rest apparatus capable of being mounted on an archery bow adjacent the point of contact of an arrow with said bow, said arrow rest apparatus including support means for aiding in mounting said arrow rest apparatus on an archery bow, said arrow rest apparatus further including a shaft member rotatably carried by said support means, said shaft member being oriented so that the axis thereof is substantially perpendicular to the axis of said arrow, first biasing means urging rotation of said shaft member in one direction, arrow supporting means affixed to said shaft member for supporting an arrow in a position to be propelled, latch means operatively connected to said shaft member, second biasing means urging said latch means into a position to retain said shaft member against rotation in said one direction, an arm portion moveably mounted on said support means, said arm portion including a weighted section, said weighted section resisting movement of said arm portion upon release of an arrow allowing relative movement between said latch means and said arm portion and said latch means will release said shaft member for rotation in said one direction, and means for releasably mounting said support means on an archery bow.

2. Arrow rest apparatus according to claim 1 wherein said support means includes an opening through which said shaft member extends.

3. Arrow rest apparatus according to claim 1 wherein said latch means includes two portions, one of said latch portions includes notch means and the other of said latch portions includes means engageable with said notch means.

4. Arrow rest apparatus according to claim 3 wherein said notch means is located on a circular section disposed on said shaft member.

5. Arrow rest apparatus according to claim 1 wherein said weighted section of said arm portion is separable from said arm portion.

6. Arrow rest apparatus according to claim 1 wherein said first biasing means includes a circular section disposed on said shaft member and a coil spring member having one end affixed to said circular section and the other end affixed to said support means.

7. Arrow rest apparatus according to claim 1 wherein said first biasing means is disposed on one side of said support means and said latch means is disposed on the other side of said support means.

8. Arrow rest apparatus according to claim 1 including stop means for controlling the travel of said arm portion.

9. Arrow rest apparatus according to claim 8 wherein said second biasing means and said stop means are associated in a subassembly.

10. Arrow rest apparatus according to claim 9 wherein said stop means is adjustable.

11. Arrow rest apparatus according to claim 1 wherein said arm supporting means is affixed to the end of said shaft member closest to said arrow.

12. Arrow rest apparatus according to claim 1 wherein said arm portion is pivotally mounted on said support means.

13. Arrow rest apparatus according to claim 1 wherein said arm portion is longitudinally moveable.

14. Arrow rest apparatus according to claim 1 wherein said arrow rest apparatus is capable of being mounted in a cavity within said archery bow.

* * * * *